United States Patent [19]

Abramo

[11] Patent Number: 4,523,637

[45] Date of Patent: Jun. 18, 1985

[54] SYSTEM FOR THE REFRIGERATION OF LIQUIDS AND/OR GASES

[76] Inventor: Carlos A. D. Abramo, Av. Almirante Ari Parreiras 337-ap 201, Niteroi, Rio de Janeiro-24230, Brazil

[21] Appl. No.: 396,916

[22] PCT Filed: Nov. 25, 1981

[86] PCT No.: PCT/BR81/00010

§ 371 Date: Jun. 29, 1982

§ 102(e) Date: Jun. 29, 1982

[87] PCT Pub. No.: WO82/01937

PCT Pub. Date: Jun. 10, 1982

[30] Foreign Application Priority Data

Nov. 26, 1980 [BR] Brazil ..... 8007709

[51] Int. Cl.[3] ..... F28D 7/00

[52] U.S. Cl. ..... 165/104.34; 62/515; 165/140; 165/164

[58] Field of Search ..... 165/164, 104.34, 140, 165/169; 62/513, 515; 219/301, 303, 304

[56] References Cited

U.S. PATENT DOCUMENTS

| | | | |
|---|---|---|---|
| 1,544,159 | 6/1925 | Jento | 219/304 |
| 2,430,774 | 11/1947 | Lynn | 165/164 X |
| 2,576,558 | 11/1951 | Bede | 219/304 |
| 2,578,280 | 12/1951 | Barnard | 219/301 |
| 2,621,903 | 12/1952 | Cohler | 165/164 X |
| 3,269,422 | 8/1966 | Matthews et al. | 165/164 X |

FOREIGN PATENT DOCUMENTS

| | | | |
|---|---|---|---|
| 224102 | 5/1958 | Australia | 165/164 |
| 1116247 | 11/1961 | Fed. Rep. of Germany | 165/164 |
| 938372 | 10/1963 | United Kingdom | 165/164 |
| 1427586 | 3/1976 | United Kingdom | 219/301 |

*Primary Examiner*—Albert W. Davis, Jr.
*Attorney, Agent, or Firm*—Emory L. Groff, Jr.

[57] ABSTRACT

The invention consists of a central tube (1) manufactured of high thermal conductivity materials in which a liquid or gas is made to pass at low temperature thus refrigerating other tubes (2) around its periphery also made of high conductivity materials which are in contact with the central tube. The system may be joined and insulated by an external tube (4) of insulating material and which forms a cold chamber (3) among the internal tube (1) and the peripherals (2) which assists the heat exchange. The number and the diameter of the peripheral tubes (2) for heat exchange is a function of the desired capacity and of the number of liquids and/or gases that it is desired to refrigerate at the same time. In order to further increase the efficiency of the system, the peripheral tubes (2) may be wound around the central tube (1), thereby increasing the total difference of the length between the tubes and the performance of the system. The system thus conceived may be maintained in a straight line or wound, permitting easy installation, low cost and manufacturing facility.

7 Claims, 4 Drawing Figures

SYSTEM FOR THE REFRIGERATION OF LIQUIDS AND/OR GASES

DESCRIPTION

The present invention relates to a system for the refrigeration of liquids and/or gases, utilizing permanent elements arranged in one group.

The system comprises the utilization of a cluster of tubes made of high thermal conductibility materials, where in the central or internal tube a gas or liquid is made to pass at low temperature and in the tubes around its periphery the gases or liquids it is desired to refrigerate pass. The tubes may be maintained in contact by an external joining tube made of plastic or rubber, which, besides exerting pressure to join the tubes together, helps to insulate the group in tubes, and creates a gaseous refrigerated atmosphere, which acts as an additional area for heat exchange in the peripheral tubes. Considering that once there is sufficient power of refrigeration in the internal tube, the heat exchange will be greater however much greater is the total difference of lengths between the internal tube and the external tubes, the external tubes may be wound around the internal tube which serves as axis, thus gaining up to 20% of length in relationship to the linear placing of the tubes. The capacity of the system shall be preset and is dependent upon its total length, as well as the difference in diameter between the internal refrigeration tube and the external refrigerated tubes, it being that however smaller (in diameter) the external tubes are in relationship to the internal tube, the greater shall be the heat exchange.

The system under consideration is extremely safe since there are always two tubular walls separating the refrigerating liquid and/or gas of the liquids and/or gases to be refrigerated, yet enabling the refrigeration of as many liquids and/or gases as are the number of the external refrigerated tubes or only one liquid or gas utilizing appropriate connections to join the whole refrigerated tube network to the liquid and/or gas tubing in question. The tube cluster thus obtained is easy to thermally insulate and may be maintained stretched as well as curved for easy installation when required by the particular project, thus obtaining an easily manufactured machine, with low cost, maximum safety and high performance in relationship to the present refrigeration coils.

In the accompanying drawings a preferred embodiment is illustrated wherein.

Figure 1:
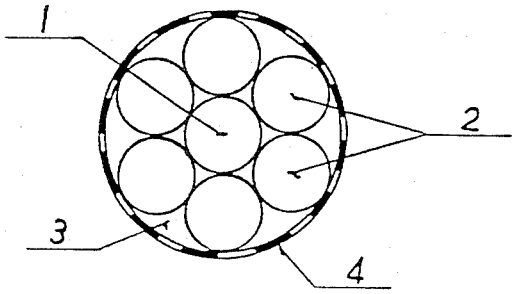
FIG. 1 shows a transverse section showing the central refrigeration tube (1), the peripheral heat exchanger tubes (2), the auxiliary gas atmosphere for heat exchanging (3), and the external joining and insulating tube (4).
Figure 2:
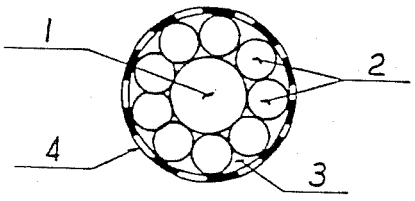
FIG. 2 shows a transverse section of the system, wherein the central refrigeration tube (1), is surrounded by a greater number of peripheral heat exchanger tubes of smaller diameter (2), the auxiliary gas atmosphere for heat exchanging (3) and the external joining and insulating tube (4).
Figure 3:
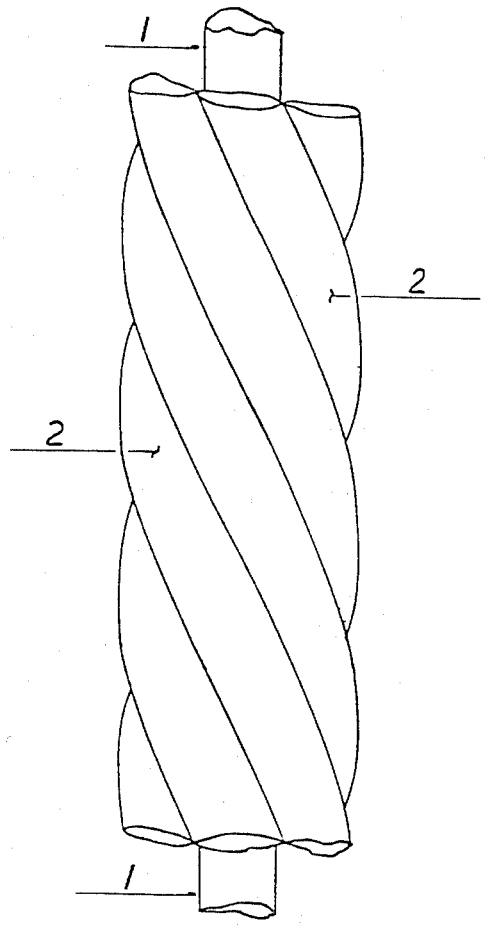
FIG. 3 shows the peripheral heat exchanging tubes (2) wound around the internal refrigeration tube (1).
Figure 4:
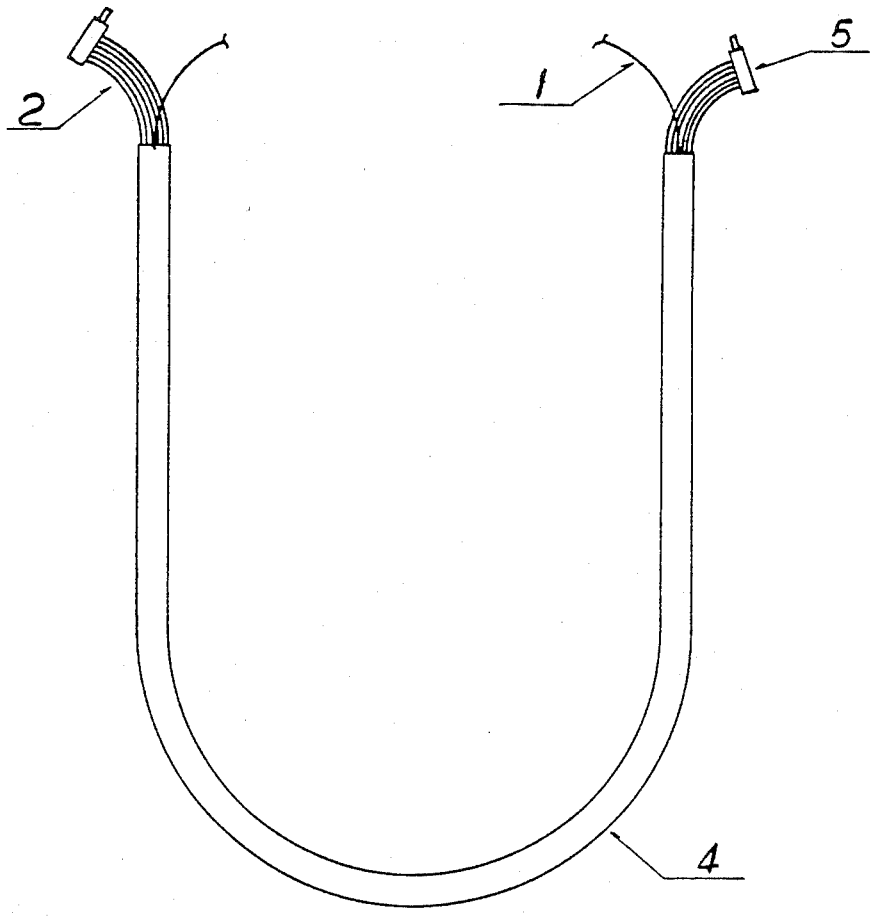
FIG. 4 shows a general view of the group showing the internal refrigeration tube (1), the peripheral heat exchanging tubes (2), linked to the multitubular connections (5), and the external joining and insulating tube (4).

I claim:

1. Heat exchange system comprising a central internal tube through which a refrigerating medium passes, a plurality of external heat exchanger tubes completely surrounding the periphery of said central internal tube, each and every heat exchanger tube in surface to surface contact with the periphery of said central internal tube through which the medium to be refrigerated passes, each and every said heat exchanger tube in surface to surface contact with two adjacent ones of said heat exchanger tubes as well as in surface to surface contact with the periphery of said central internal tube and an outer insulating tube surrounding and engaging all said external heat exchanger tubes and maintaining them in contact with each other and in contact with said central internal tube thereby creating a cold chamber enclosing all of said tubes.

2. A heat exchange system according to claim 1 wherein, said external heat exchanger tubes each contain the same medium to be cooled.

3. A heat exchange system according to claim 1 wherein, each said external heat exchanger tube contains a different medium to be cooled.

4. A heat exchange system according to claim 1 wherein, said external heat exchanger tubes are disposed with their axes parallel to the axis of said central internal tube.

5. A heat exchange system according to claim 1 wherein, said external heat exchanger tubes are disposed spirally around said central internal tube.

6. A heat exchanger system according to claim 1 wherein, said central internal tube and external heat exchanger tubes are of the same diameter.

7. A heat exchanger system according to claim 1 wherein, said external heat exchanger tubes are of smaller diameter than said central internal tube.

* * * * *